US011549729B2

(12) United States Patent
Makoto et al.

(10) Patent No.: US 11,549,729 B2
(45) Date of Patent: Jan. 10, 2023

(54) COOL AIR SUPPLYING APPARATUS AND REFRIGERATOR HAVING THE SAME

(71) Applicant: Samsung Electronics Co., Ltd., Suwon-si (KR)

(72) Inventors: Kobayashi Makoto, Yokohama (JP); Suzuki Toshiaki, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/520,226

(22) Filed: Jul. 23, 2019

(65) Prior Publication Data

US 2020/0025420 A1 Jan. 23, 2020

(30) Foreign Application Priority Data

Jul. 23, 2018 (JP) ..... JP2018-137693
Jun. 17, 2019 (KR) ..... 10-2019-0071642

(51) Int. Cl.
*F25B 9/14* (2006.01)
*F25B 21/02* (2006.01)

(52) U.S. Cl.
CPC ..... *F25B 9/14* (2013.01); *F25B 21/02* (2013.01)

(58) Field of Classification Search
CPC ..... F25B 9/14; F25B 1/02
See application file for complete search history.

(56) References Cited

U.S. PATENT DOCUMENTS 2,486,081 A * 10/1949 Weenen ..... F25B 9/14 62/6
6,585,494 B1 7/2003 Suzuki
2001/0049997 A1* 12/2001 Ahn ..... F04B 27/1072 92/12.2

(Continued)

FOREIGN PATENT DOCUMENTS

CN 101012785 A 8/2007
DE 19913154 A1 * 10/1999 ..... F04B 27/1081

(Continued)

OTHER PUBLICATIONS

Takashi, Wobble Plate Stirling cooler with reduced size and eight and increased cooling performance, 1999, Full Document (Year: 1999).*

(Continued)

*Primary Examiner* — Nael N Babaa

(57) ABSTRACT

A cool air supplying apparatus includes a swash plate shaft connected to a motor and extending in a predetermined axial direction; a compression swash plate obliquely coupled to the swash plate shaft; a compression piston configured to reciprocate in the axial direction by the rotation of the compression swash plate; a compression cylinder in which a working fluid is compressed by the compression piston, an expansion swash plate obliquely coupled to the swash plate shaft; an expansion piston configured to reciprocate in the axial direction by the rotation of the expansion swash plate; and an expansion cylinder arranged with the compression cylinder in the axial direction and configured to expand a working fluid compressed by the compression cylinder; and the compression swash plate and the expansion swash plate are installed in the swash plate shaft with a predetermined phase difference.

10 Claims, 12 Drawing Sheets

(56) References Cited

U.S. PATENT DOCUMENTS

| | | | |
|---|---|---|---|
| 2011/0030367 | A1 | 2/2011 | Dadd |
| 2014/0182311 | A1 | 7/2014 | Kim et al. |

FOREIGN PATENT DOCUMENTS

| | | | |
|---|---|---|---|
| DE | 199 53 512 | C1 | 10/2000 |
| JP | H11-287525 | A | 10/1999 |
| JP | 2001-012358 | A | 1/2001 |
| JP | 2009144598 | A | 7/2009 |
| KR | 10-1999-0035547 | A | 5/1999 |
| KR | 10-2014-0045652 | A | 4/2014 |

OTHER PUBLICATIONS

ISA/KR, International Search Report and Written Opinion of the International Searching Authority, International Application No. PCT/KR2019/009098, dated Nov. 18, 2019, 3 pages.
Supplementary European Search Report dated Jul. 6, 2021 in connection with European Patent Application No. 19 84 0997, 7 pages.
Office Action dated Dec. 17, 2021 in connection with Chinese Patent Application No. 201980049504.3, 20 pages.

* cited by examiner

COOL AIR SUPPLYING APPARATUS AND REFRIGERATOR HAVING THE SAME

CROSS-REFERENCE TO RELATED APPLICATIONS

This application is based on and claims priority under 35 U.S.C. 119 to Korean Patent Application No. 10-2019-0071642, filed on Jun. 17, 2019, in the Korean Intellectual Properly Office, and Japanese Patent Application No. 2018-137693 filed on Jul. 23, 2018, in the Japan Patent Office, the disclosures of which are herein incorporated by reference in their entireties

BACKGROUND

Field

The disclosure relates to a Stirling cryocooler.

Description of Related Art

Energy saving measures for a refrigerator in which the current flows all day is urgent business as a part of solutions for global environmental conservation and global warming. It has been studied to apply a Stirling cryocooler to a refrigerator instead of evaporative refrigeration cycle, as the energy saving measures.

The Stirling cryocooler is operated in such a way that one swash plate is provided about a swash plate shaft rotated by a motor, and an end portion of a compression piston and an end portion of an expansion piston reciprocate by the rotation of the swash plate, so as to repeatedly compress a working fluid in the compression cylinder and to repeatedly expand the working fluid in the expansion cylinder (refer to Japanese Patent Application Laid-Open No. 11-287525).

SUMMARY

However, such a conventional Stirling refrigeration cycle has the following limitations.

In the conventional swash plate type Stirling cryocooler, because the compression piston and the expansion piston are installed for one swash plate, the phase difference is fixed in the arrangement of the pistons in the circumferential direction. Therefore, it is difficult to optimally design a Stirling refrigeration cycle for implementing the maximum refrigeration efficiency.

In order to provide an ideal phase difference to the compression piston and the expansion piston, it is required that the compression cylinder and the expansion cylinder are arranged at positions displaced in the circumferential direction, respectively, and connected by a separate connecting pipe to allow the working fluid to flow between the respective cylinders. However, as a result, the connecting piping becomes longer, and a dead volume, which does not contribute to the compression and expansion of the working fluid, increases, thereby significantly reducing the output.

In addition, there is also a difficulty that the Stirling refrigeration cycle itself becomes large in size by providing the connecting pipe.

Further, when the flow path length of the connecting pipe is long, a flow loss of the working fluid is also generated, and the performance is also deteriorated.

In addition, because an ideal phase difference in the reciprocating motion of the pistons is generated by the arrangement of the cylinders, the arrangement of the cylinders is almost fixed. As a result, it is difficult to freely design the number of sets of cylinders while maintaining the phase difference.

Therefore, it is an aspect of the present disclosure to provide a Stirling cryocooler capable of solving the above mentioned difficulties at once.

Additional aspects of the present disclosure will be set forth in part in the description which follows and, in part, will be obvious from the description, or may be learned by practice of the present disclosure.

in accordance with an aspect of the disclosure, a Stirling cryocooler includes a swash plate shaft connected to a motor and extending in a predetermined axial direction, a compression swash plate obliquely coupled to the swash plate shaft, a compression piston configured to reciprocate in the axial direction by the rotation of the compression swash plate, a compression cylinder in which a working fluid is compressed by the compression piston, an expansion swash plate obliquely coupled to the swash plate shaft, an expansion piston configured to reciprocate in the axial direction by the rotation of the expansion swash plate and an expansion cylinder arranged with the compression cylinder in the axial direction and configured to expand a working fluid compressed by the compression cylinder, and the compression swash plate and the expansion swash plate are installed in the swash plate shaft with a predetermined phase difference.

With this configuration, a phase difference required for the reciprocating motion of the compression piston and the expansion piston may be set by a phase different of the compression swash plate and the expansion swash plate. Accordingly, because the arrangement of the compression cylinder and the expansion cylinder is not constrained by the set phase difference, the compression cylinder and the expansion cylinder may be arranged in the axial direction.

Therefore, the compression cylinder and the expansion cylinder are not required to be displaced at a predetermined angle in the circumferential direction as in the conventional manner and thus a flow path, on which the working fluid flows between the compression cylinder and the expansion cylinder, may have a length shorter than that of the conventional manner. Accordingly, it is possible to make a dead space small and to reduce the flow loss of the working fluid, and thus it is possible to make the apparatus itself small with the high efficiency.

Because the compression cylinder and the expansion cylinder are arranged in a line, the number of sets of cylinders may freely set in comparison with the conventional manner, and the optimal design may be easily realized.

As for an appropriate range of the phase difference of the compression swash plate and the expansion swash plate that can realize high efficiency of the Stirling cryocooler, a phase difference of the phase difference of the compression swash plate and the expansion smash plate may be set to equal to or greater than 80° and equal to or less than 100°.

For the Stirling cryocooler, in which the appropriate phase difference is provided in terms of the high efficiency, a phase difference of the phase difference of the compression swash plate and the expansion swash plate may be set to approximately 90°.

In order to form the flow path, on which the working fluid flows between the compression cylinder and the expansion cylinder, as short as possible and to increase the refrigerating efficiency, a heater in which the working fluid compressed by the compression cylinder 41 radiates heat to the outside air, a cooler in which the working fluid expanded by the expansion cylinder absorbs heat from the outside, and a regenerator configured to accumulate heat of the working fluid passed through the heater and configured to raise a temperature of the working fluid, which is passed through the cooler, by using the accumulated heat and between the compression cylinder and the expansion cylinder, the heater, the regenerator and the cooler may be arranged in the axial direction.

As another example of a separated component for improving the refrigeration efficiency in comparison with the conventional manner, a heater in which the working fluid compressed by the compression cylinder radiates heat to the outside air, a cooler in which the working fluid expanded by the expansion cylinder absorbs heat from the outside, and a regenerator configured to accumulate heat of the working fluid passed through the heater and configured to raise a temperature of the working fluid, which is passed through the cooler, by using the accumulated heat may be provided, and between the compression cylinder and the expansion cylinder, the heater, the regenerator, and the cooler may be arranged to be displaced in the radial direction of the swash plate shaft.

For example, in order to facilitate heat exchange between the air and the working fluid, and to improve the heat exchange performance, the cooler may be provided and the cooler may be provided with a plurality of pipes on which the working fluid flows.

In order to arrange the cooler, the regenerator, and the heater in a line with the same material and to simplify the structure thereof, the regenerator may be provided with a plurality of pipes on which the working fluid flows.

In order to further improve the heat exchange efficiency between the working fluid and the air in the cooler and the heater, a fin may be provided on the surface of the pipe.

In accordance with another aspect of the disclosure, a refrigerator includes a Stirling cryocooler, a refrigerating compartment, a freezing compartment, and a controller configured to control the motor to have different the number of revolutions depending on whether to cool the refrigerating compartment or the freezing compartment, and it is possible to implement the same cooling capacity as a refrigerator provided with the evaporative refrigeration cycle while implementing the energy saving. Further, because it is possible to avoid the use of a refrigerant or a combustible refrigerant having a high environmental load, it may be effective to solve the environmental load and the global warming.

In accordance with another aspect of the disclosure, a refrigerator includes a Stirling cryocooler, a refrigerating compartment, a freezing compartment, a duct configured to connect a cooler of the Stirling cryocooler to the refrigerating compartment and the freezing compartment, and a duct switch configured to switch a flow path so that air passed through the cooler is supplied to one of the refrigerating compartment and the freezing compartment through the duct, and the temperature of the refrigerating compartment and the freezing compartment may be maintained at a desired temperature by switching the duct without changing the number of revolutions of the motor of the Sterling cryocooler.

In accordance with another aspect of the disclosure, a refrigerator includes a Stirling cryocooler, a refrigerating compartment, a freezing compartment, and a brine circuit configured to perform heat exchange between a cooler of the Stirling cryocooler and air inside the refrigerating compartment or the freezing compartment, by using brine, and the refrigerating compartment and the freezing compartment may be effectively cooled by the cooler by using brine.

When the brine circuit includes a brine pump for circulating the brine, the refrigerating compartment and the freezing compartment may be cooled by circulating the brine regardless of the position of the Stirling cryocooler in the refrigerator.

In order to cool the refrigerating compartment and the freezing compartment with a small power consumption for the circulation of the brine, the Stirling cryocooler may be arranged above the refrigerating compartment and the freezing compartment, and the brine may circulate in the brine circulate by the thermal siphon.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of embodiments, taken in conjunction with the accompanying drawings of which.

FIG.

DETAILED DESCRIPTION

Figure 1:
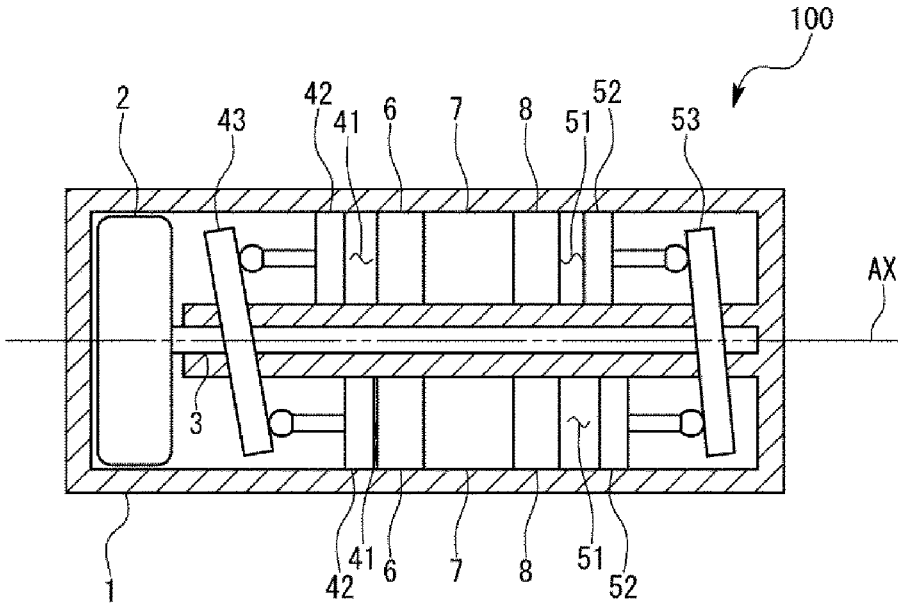
FIG. 1 is a schematic longitudinal sectional view illustrating a Stirling cryocooler according to an embodiment of the disclosure.

FIGS. 1 through 9, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front end", "rear end", "upper portion", "lower portion", "upper end", "lower end" and the like may be defined by the drawings, but the shape and the location of the component is not limited by the term.

The disclosure will be described more fully hereinafter with reference to the accompanying drawings A Stirling cryocooler 100 according to an embodiment of the disclosure will be described with reference to FIG. 1

The Stirling cryocooler 100 is used for generating cold air in a refrigerator, for example. Particularly, the Stirling cryocooler 100 is configured such that a plurality of sets of cylinders and pistons is placed in a substantially cylindrical casing 1 having a sealed inside, and a working fluid repeats cycles of compression, heat radiation, expansion, and heat absorption. A material that has a low critical point and it is difficult to be liquefied in the course of the cycle is selected as the working fluid. Particularly, helium, nitrogen, or hydrogen is used as the working fluid.

That is, the Stirling cryocooler 100 operates by rotating a swash plate shaft 3 that extends in the axial direction AX of the casing 1 and is connected to a motor 2. The Stirling cryocooler 100 includes a compression cylinder 41 compressing the working fluid filled in the casing 1 by a reciprocating motion of a compression piston 42, and an expansion cylinder 51 expanding the working fluid, which is compressed by the compression cylinder 41, by a reciprocating motion of the expansion piston 52. According to an embodiment, a single set of the compression cylinder 41 and the expansion cylinder 51 is arranged at intervals of 90 degrees in the circumferential direction. In addition, a set of the compression cylinder 41 and the expansion cylinder 51, through which the working fluid flows, is arranged in the axial direction AX.

The compression piston 42 and the expansion piston 52 are configured to repeat the reciprocating motion with a predetermined phase difference. In an embodiment, an inner surface of the compression piston 42 and an inner surface of the expansion piston 52 are arranged to face each other.

Particularly, the compression piston 42 is configured to repeat the reciprocating motion by a compression swash plate 43 installed obliquely to the motor 2 side of the swash plate shaft 3. Particularly, the compression swash plate 43 is installed such that a surface portion thereof is inclined with respect to the axial direction AX of the swash plate shaft 3.

The expansion piston 52 is configured to repeat the reciprocating motion by an expansion swash plate 53 provided on one end side of the swash plate shaft 3. Particularly, the expansion swash plate 53 is installed such that a surface portion thereof is inclined with respect to the axial direction AX of the swash plate shaft 3.

The compression swash plate 43 and the expansion swash plate 53 are arranged to have different installation directions in the circumferential direction with respect to the swash plate shaft 3 so that the working fluid repeats isothermal compression, isochoric process, and isothermal expansion in the compression cylinder 41 and the expansion cylinder 51 arranged to be aligned with the axial direction AX. Therefore, the compression swash plate 43 and the expansion swash plate 53 are provided on the swash plate shaft 3 with a predetermined phase difference. According to an embodiment, the phase difference between the compression swash plate 43 and the expansion swash plate 53 is set to equal to or greater than 80° and equal to or less than 100 The phase difference between the compression swash plate 43 and the expansion swash plate 53 may be set to approximately 90°.

In an embodiment, a heater 6, a regenerator 7 and a cooler 8 are arranged between the compression cylinder 41 and the expansion cylinder 51 so as to be aligned in the axial direction AX.

The heater 6 is a portion in which the working fluid compressed by the compression cylinder 41 radiates heat to the outside air so as to heat the air.

The cooler 8 is a portion in which the working fluid expanded by the expansion cylinder 51 absorbs heat from the outside so as to cool the air.

The regenerator 7 is installed between the heater 6 and the cooler 8, absorbs the heat of the working fluid that has passed through the heater 6, accumulates the heat, and raises a temperature of the working fluid, which is passed through the cooler 8, by using the accumulated heat.

Because the Stirling cryocooler 100 according to an embodiment is configured such that the compression cylinder 41, the heater 6, the regenerator 7, the cooler 8 and the expansion cylinder 51 in which the working fluid flows are arranged to be aligned with the axial direction AX, a connecting pipe in the conventional manner is not provided. Therefore, a dead volume which does not contribute to compression and expansion of the working fluid may be minimized. In addition, because the length of the flow path through which the working fluid flows may be minimized, the flow resistance of the working fluid may also be suppressed. In this respect, it is possible to improve the cooling efficiency in comparison with the conventional one, while making the size of the Stirling cryocooler 100 compact.

Further, a phase difference may be formed by varying the installation direction of the compression swash plate 43 and the expansion swash plate 53 in the circumferential direction of the swash plate shaft 3, and thus a phase difference of the reciprocating motion of the compression piston 42 and the expansion piston 52, which are provided in a pair, may be formed. Therefore, the phase difference is not required to be formed by making the arrangement of the compression cylinder 41 and the expansion cylinder 51 different from each other in the circumferential direction as in the conventional manner, and it is possible to arrange the compression cylinder 41 and the expansion cylinder 51 to be aligned with the axial direction AX. With this feature, it is possible to remove the connecting pipe and to reduce the dead volume and. the length of the flow path, as mentioned above. Further, the compression cylinder 41, the heater 6, the regenerator 7, the cooler 8 and the expansion cylinder 51 are arranged to be aligned with the axial direction AX and thus when a plurality of sets of those components is installed, the restriction on the arrangement is smaller than the conventional manner. Therefore, other than four sets as in one embodiment, it is easy to provide the great number of sets of compression cylinders 41 and expansion cylinders 51.

Further, because the two swash plates such as the compression swash plate 43 and the expansion swash plate 53 are provided, it is possible to separately install two swash plates and freely adjust the phase difference of each swash plate and the phase difference of the reciprocating motion of the compression piston 42 and the expansion piston 52. Therefore, it is easy to realize a phase difference at which the cooling efficiency becomes the highest.

Next, a Stirling cryocooler 100 according to another embodiment will be described with reference to FIG. 2, The members corresponding to the members described in the FIG. 1 are denoted by the same reference numerals.

The Stirling cryocooler 100 according to an embodiment is arranged such that a heater 6, a regenerator 7 and a cooler 8 are displaced in the radial direction, which is different from other embodiments in which the heater 6, the regenerator 7 and the cooler 8 are arranged in a line between the compression cylinder 41 and the expansion cylinder 51. Further, an inner surface of the compression piston 42 and the expansion piston 52 are arranged to be directed outwardly.

Particularly, in the casing 1, the heater 6, the regenerator 7, and the cooler 8 are arranged in a line in a position outer than the compression cylinder 41 and the expansion cylinder 51 in the radial direction according to an embodiment. In addition, the working fluid, which is compressed by the compression cylinder 41, moves to the motor 2 side, which is opposite to the expansion cylinder 51, and passes through the heater 6, the regenerator 7, and the cooler 8, which are arranged at the outer circumferential side, and enters the expansion cylinder 51 from the end side. The working fluid expanded by the expansion cylinder 51 is returned to the compression cylinder 41 in the reverse order of the above.

The phase difference of the reciprocating motion of the compression piston 42 and the expansion piston 52 is adjusted by the phase difference according to the installation direction of the compression swash plate 43 and the expansion swash plate 53 in the same manner as in FIG. 1.

Figure 2:
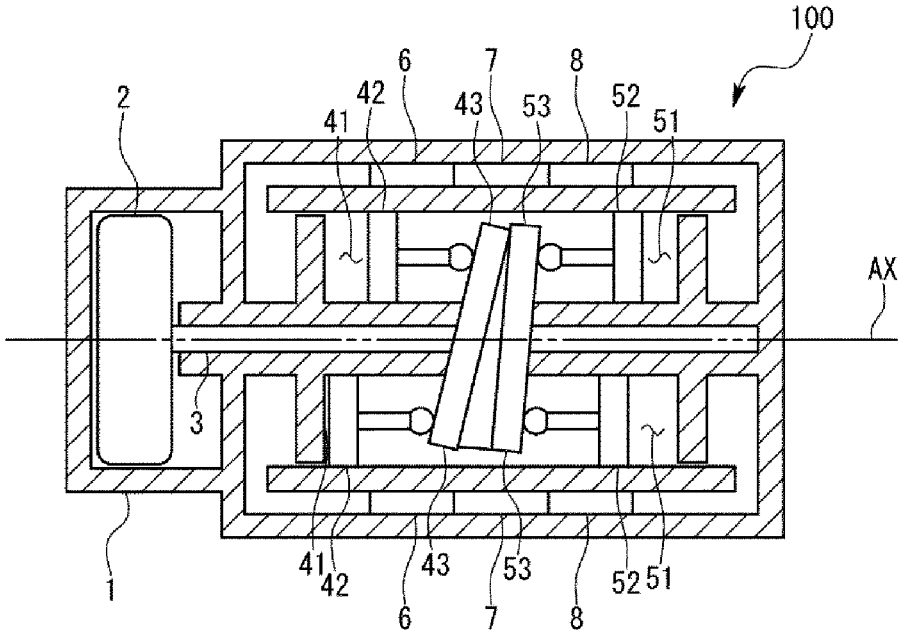
FIG. 2 is a schematic longitudinal sectional view illustrating a Stirling cryocooler according to an embodiment of the disclosure.

In the Stirling cryocooler 100 as depicted in FIG. 2, it is possible to set a phase difference of a need operation in the cycle by the phase difference of the compression swash plate 43 and the expansion swash plate 53, which is the same manner as FIG. 1. In the same manner as in FIG. 1, the set of compression cylinder 41 and the expansion cylinder 51 in which the working fluid flows may arranged in the axial direction AX. Therefore, even when a plurality of sets of the compression cylinder 41 and the expansion cylinder 51 is provided in the casing 1, the arrangement is not limited by the phase difference, and it is possible to easily design the optimal arrangement thereof.

Further, because it is sufficient to form the flow path on which the working fluid flows, by using the inside of the casing 1, it is not required to install the connecting pipe having a portion extending in the radial direction of the casing 1, and thus it is possible to make the flow path short and to reduce the dead volume and the flow resistance.

Because the heater 6 and the cooler 8 are arranged on the outer circumferential side of the casing 1, it is possible to make an area of a region, in which heat is exchanged with the outside air through the casing 1, larger than that of FIG. 1, and thus it is possible to increase the amount of heat exchange.

Next, a Stirling cryocooler 100 according to another embodiment will be described with reference to FIGS. 3A and 3B. The members corresponding to the members described in FIG. 1 are denoted by the same reference numerals.

Figure 3A:
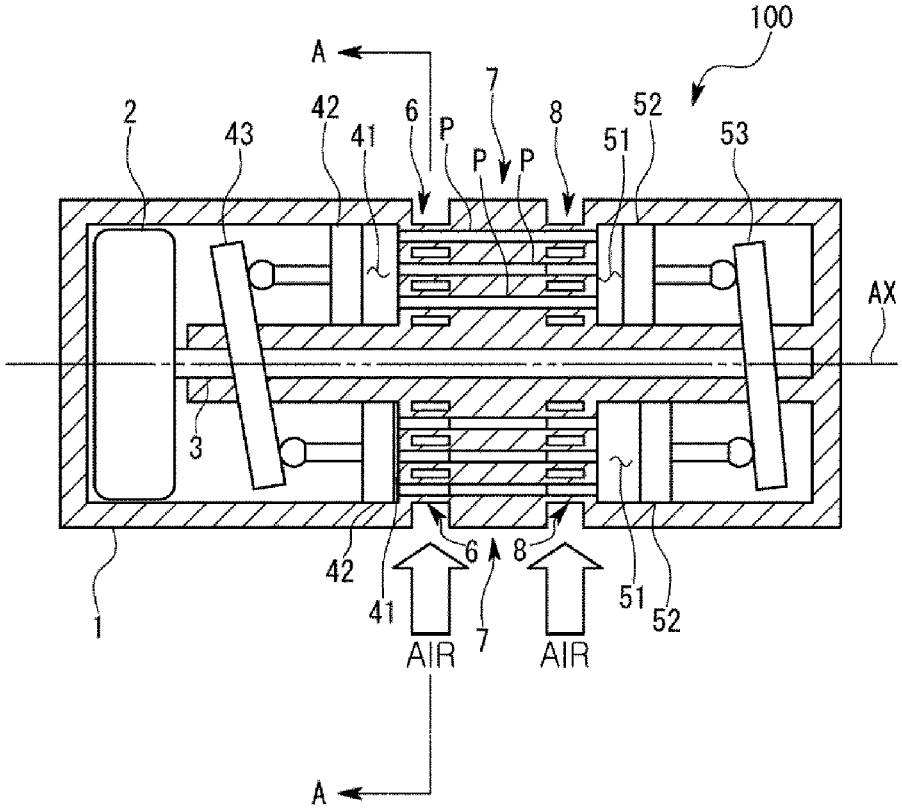
FIG. 3A is a schematic longitudinal sectional view illustrating a Stirling cryocooler according to an embodiment of the disclosure.
Figure 3B:
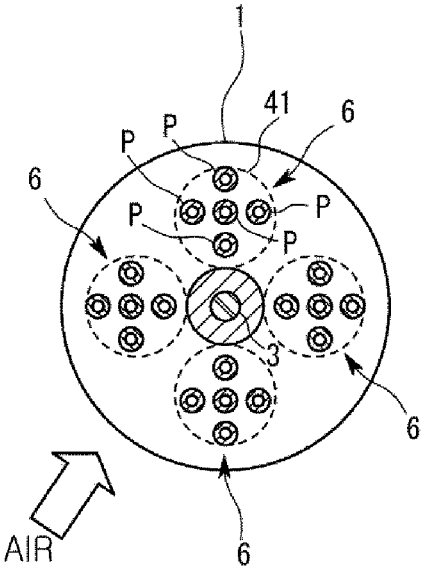
FIG. 3B illustrates a schematic cross-sectional view taken along line A-A of FIG. 3A.

The Stirling cryocooler 100 as depicted in FIGS. 3A and 3B differs from the Stirling cryocooler 100 as depicted in FIG. 1 in the construction of the heater 6, the regenerator 7 and the cooler 8. Particularly, the heater 6, the regenerator 7, and the cooler 8 are formed with a plurality of pipes P in which the working fluid flows. Further, the heater 6 and the cooler 8 are arranged in a cutout portion of the casing 1 to allow an outer surface of the plurality of pipes to be directly exposed to the outside air, and thus the surface area contributing to the heat exchange is set to be large.

With the Stirling cryocooler 100 as depicted in FIGS. 3A and 3B, in the heater 6 and the cooler 8, the amount of heat exchange between the working fluid and the outside air may be further increased, and the refrigeration efficiency may be improved.

Because the heater 6, the regenerator 7 and the cooler 8 are each formed by a cylindrical pipe P and arranged to be aligned with the axial direction AX, it is possible to be easily assembled.

Next, a modified example of the Stirling cryocooler as depicted in FIGS. 3A and 3B will be described with reference to FIGS. 4A and 4B.

Figure 4A:
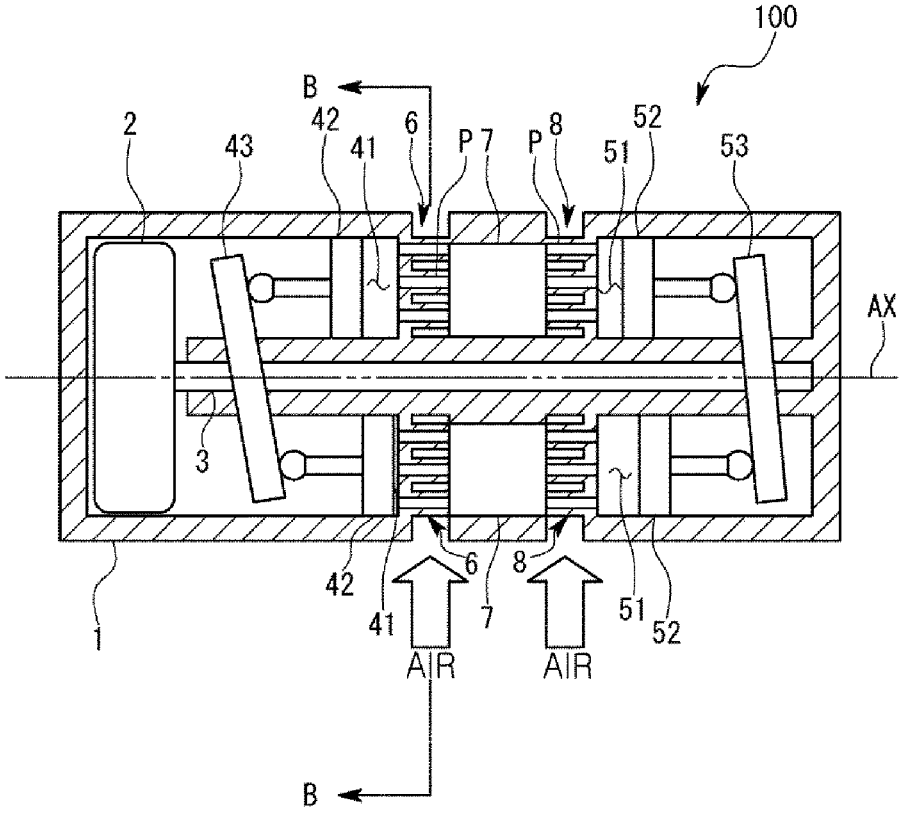
FIG. 4A is a schematic longitudinal sectional view illustrating a modified example of the Stirling cryocooler according to an embodiment of the disclosure.
Figure 4B:
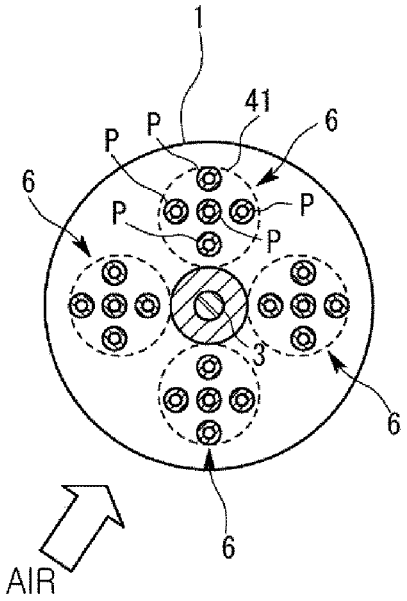
FIG. 4 illustrates a schematic cross-sectional view taken along line 13-13 of FIG. 4A.

The heater 6 and the cooler 8 may be formed of a plurality of pipes P but the regenerator 7 may not be formed of the pipe P as shown in FIGS. 4A and 4B. Even in such a case, it is possible to increase the efficiency of the heat exchange by increasing the surface area of heat exchange between the working fluid and the air.

Figure 5A:
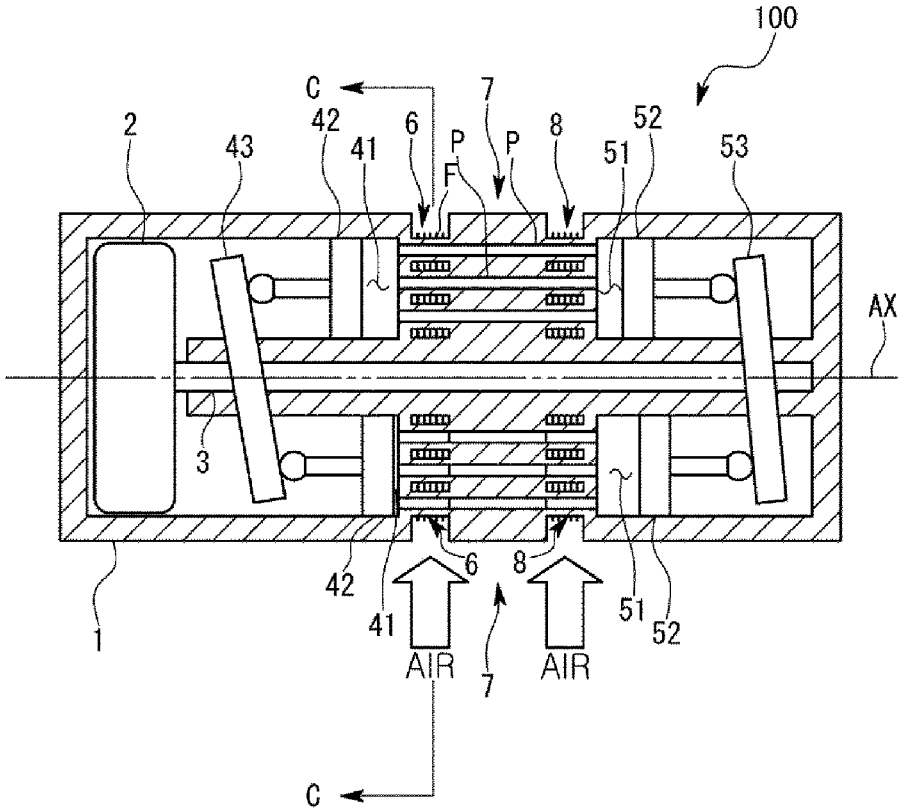
FIG. 5A is a schematic longitudinal sectional view illustrating a Stirling cryocooler according to an embodiment of the disclosure.
Figure 5B:
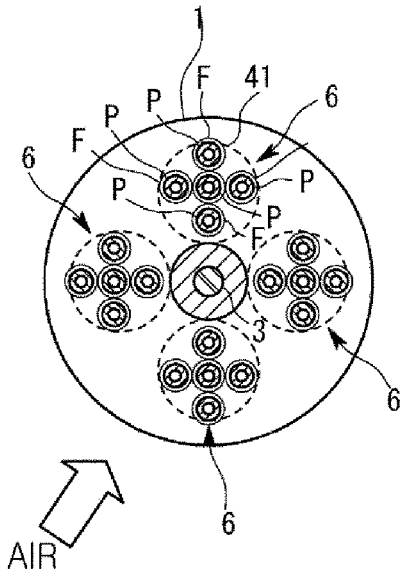
FIG. 5B illustrates a schematic cross-sectional view taken along line C-C of FIG. 5A.

Next, a Stirling cryocooler 100 according to an embodiment will be described with reference to FIGS. 5A and 5B. The members corresponding to the members described in FIG. 1 are denoted by the same reference numerals.

In the Stirling cryocooler 100 as depicted in FIGS. 4A and 4B, a plurality of annular fins F is arranged on the outer surface of each pipe P in a heater 6 and a cooler 8 composed of a plurality of pipes P.

Accordingly, the heaters 6 and the coolers 8 as depicted in FIGS. 4A and 4B may further increase the surface area contributing to heat exchange, thereby increasing the efficiency of heat exchange.

Next, a refrigerator 200 according to an embodiment of the disclosure will be described with reference to FIG. 6. To the refrigerator 200, any one of the Stirling cryocooler 100 described in the various embodiments is applied.

Figure 6:
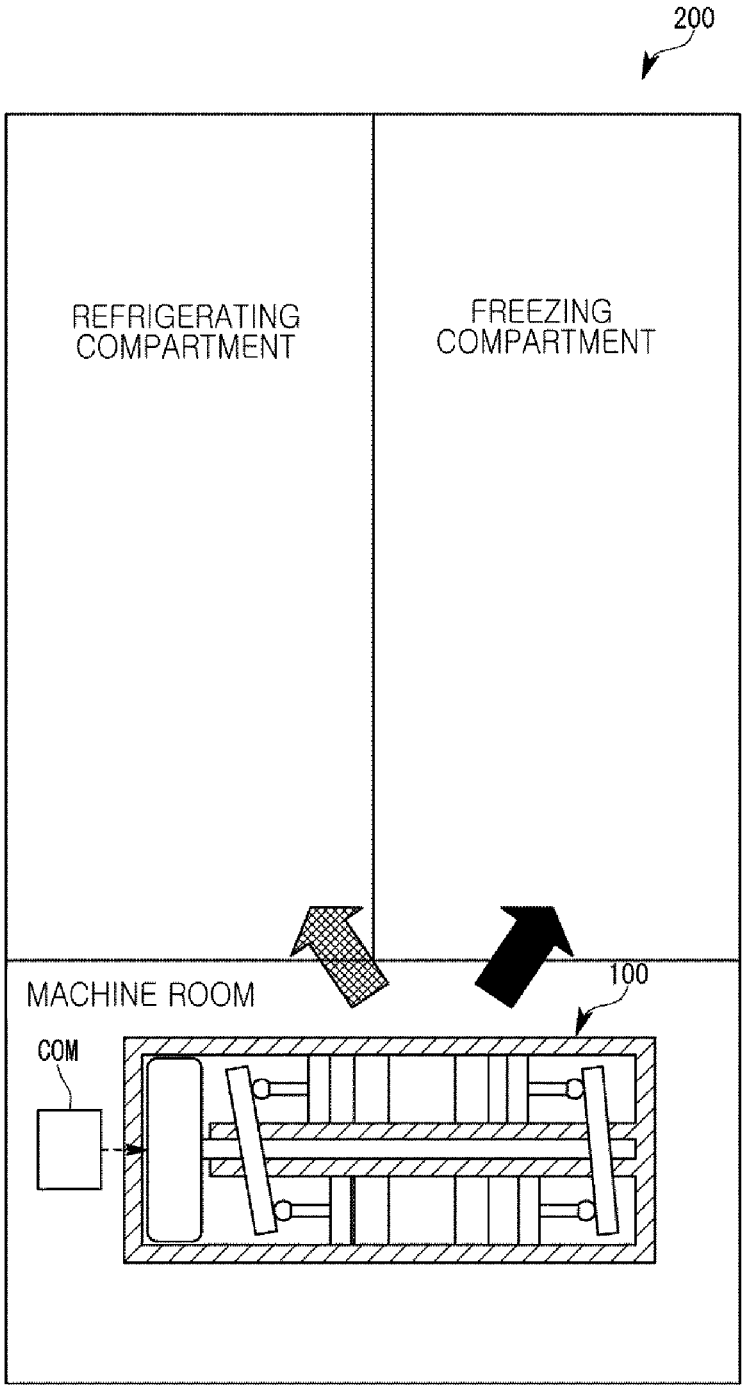
FIG. 6 is a schematic longitudinal sectional view illustrating a Stirling cryocooler and a refrigerator according to an embodiment of the disclosure.

As illustrated in FIG. 6, the refrigerator 200 includes a refrigerating compartment maintained at a predetermined temperature, a freezing compartment maintained at a temperature lower than that of the refrigerating compartment, and a machine room receiving various devices such as the Stirling cryocooler 100. A duct (not shown) is provided among the machine room, the refrigerating compartment and the freezing compartment. Air, which is cooled by the Stirling cryocooler 100 in the machine room, may be supplied to one side of the refrigerating compartment or the freezing compartment through the duct, That is, the refrigerator 200 is a direct- cooling refrigerator 200 for directly cooling the air.

According to various embodiments, a controller COM controlling the number of revolutions of the motor 2 of the Stirling cryocooler 100 is further provided. The controller COM is configured to vary the number of the revolutions of the motor 2 depending on whether to cool the refrigerating compartment or the freezing compartment. That is, a temperature of the freezing compartment is lowered by increasing the number of revolutions of the motor 2 and increasing the amount of cooling of the air when cooling the freezing compartment in comparison with when cooling the refrigerating compartment. Particularly, the function of the controller COM is implemented by a computer having a CPU, a memory, an A/D converter, a D/A converter, and various input/output devices. That is, refrigerator program stored in the memory is executed, and various devices cooperate to realize the function as the controller COM.

The controller COM may include at least one processor. The at least one processor may be electrically connected to various devices such as the motor 2 to transmit electrical signals to various devices.

With the refrigerator 200 provided with the Stirling cryocooler 100, it is possible to realize energy saving while implementing the same cooling capacity in comparison with the refrigerator 200 having the evaporative refrigeration cycle, Further, because it is possible to avoid the use of a refrigerant or a combustible refrigerant having a high environmental load, it may be effective to solve the environmental load and the global warming.

Next, a modified example of the refrigerator 200 depicted in FIG. 6 will be described with reference to FIGS. 7 to 9.

Figure 7:
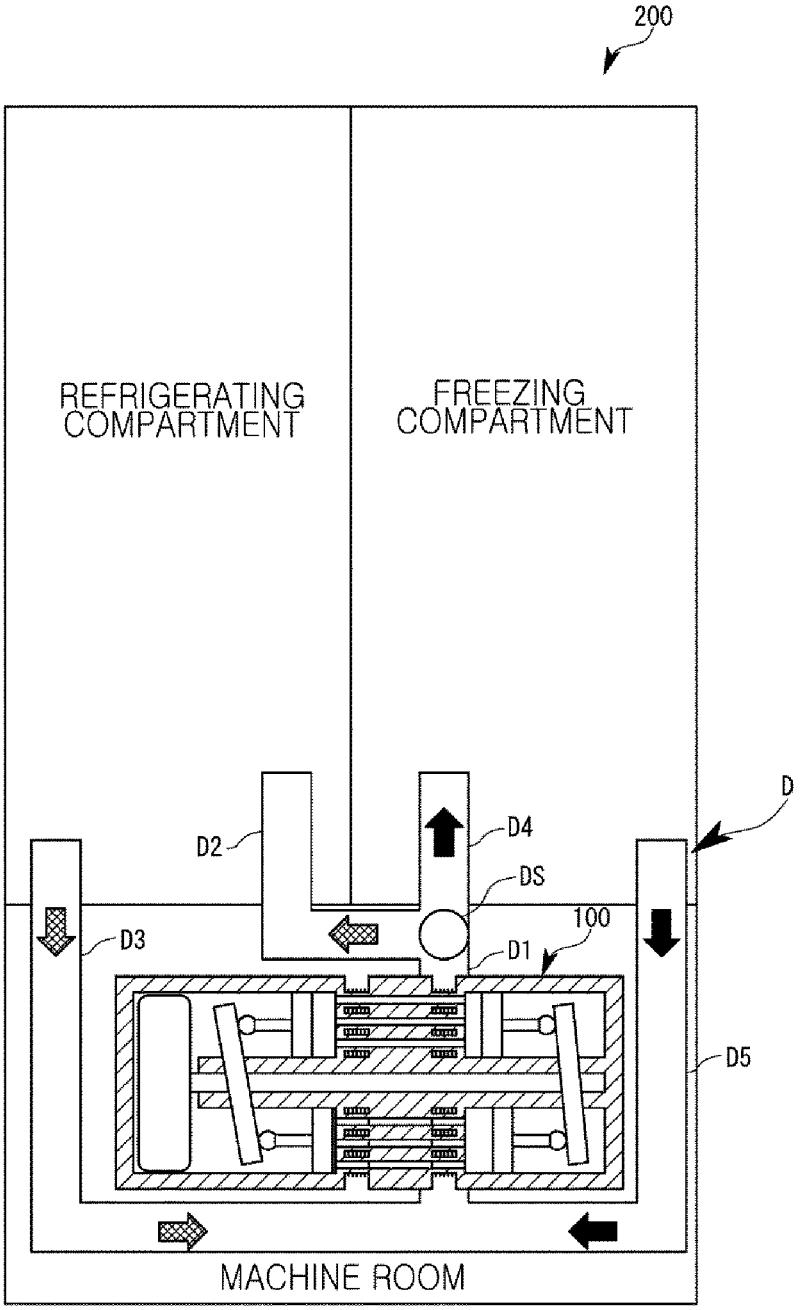
FIG. 7 is a schematic longitudinal sectional view illustrating a first modified example of the Stirling cryocooler and the refrigerator according to an embodiment of the disclosure.

The modified example of the refrigerator 200 illustrated in FIG. 7 is configured to drive the motor 2 at the same predetermined the number of revolutions upon cooling the refrigerating compartment and cooling the freezing compartment and configured to allow a temperature of the inside thereof to be controlled by switching a duct D.

Particularly, the duct D is configured to allow the air flow to pass through the cooler 8 composed of a plurality of pipes P in which fins are arranged on an outer circumference thereof, in the Stirling cryocooler 100. That is, the duct D includes a cold air discharge duct DI connecting the cooler 8 to a duct switch DS, a first cold air supply flow path D2 supplying cold air to the refrigerating compartment, a first return flow path D3 connecting the refrigerating compartment to the cooler 8 and returning the air, which is in the refrigerating compartment, from the refrigerating compartment to the suction side of the cooler 8, a second cold air supply flow path D4 connecting the duct switch DS to the freezing compartment and supplying cold air to the freezing compartment, and a second return flow path D5 connecting the freezing compartment to the cooler 8 and returning the air, which is in the freezing compartment, from the freezing compartment to the suction side of the cooler 8.

The duct switch DS switches a flow path to flow the air flow toward one of circulation circuits or to prevent the air flow from flowing toward both circulation circuits. The circulation circuits include a first circulation circuit in which air flows through the cooler 8, the cold air discharge duct D1, the first cold air supply duct D2, the refrigerating compartment, the first return duct D3 and the cooler 8 in order, and a second circulation circuit in which air flows through the cooler 8, the cold air discharge duct D1, the second cold air supply duct D4, the freezing compartment, the second return duct D5, and the cooler 8 in order.

The operation of the duct switch DS is controlled in such a way that a switching timing is controlled according to the temperature of the refrigerating compartment or the temperature of the freezing compartment. That is, the duct switch DS first circulates the air to the first circulation circuit, and when the refrigerating compartment is at a first predetermined low temperature, the duct switch DS performs a switching operation to circulate air to the second circulation circuit to start, to cool the freezing compartment. When the freezing compartment is at a second predetermined low temperature, the duct switch DS stops the circulation of the air so as not to circulate air to either the refrigerating compartment or the freezing compartment. When the temperature in the freezing compartment reaches a predetermined high temperature, the above-described operation is repeated again.

Even in such a case, by the Stirling cryocooler 100, the refrigerating compartment and the freezing compartment are maintained in a predetermined temperature range.

Figure 8:
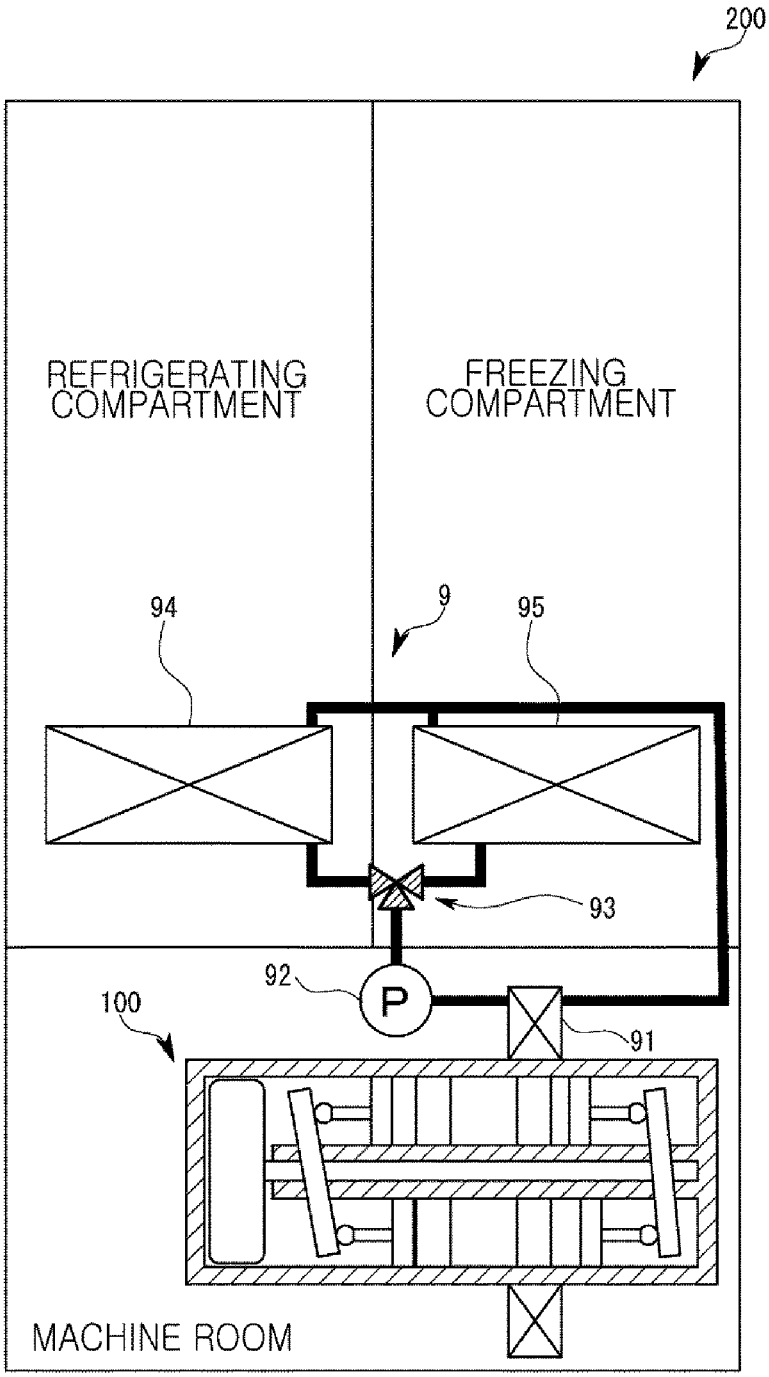
FIG. 8 is a schematic longitudinal sectional view illustrating a second modified example of the Stirling cryocooler and the refrigerator according to an embodiment of the disclosure.

In a modified example of the refrigerator 200 illustrated in FIG. 8, the refrigerating compartment and the freezing compartment may be cooled using brine. Particularly, the refrigerator 200 is provided with a brine circuit configured to circulate brine among a cooler 8 of the Stirling cryocooler 100, a heat exchanger 94 provided in the refrigerating compartment and a heat exchanger 95 provided in the freezing compartment. That is, this modified example the refrigerator 200 is a secondary cooling type refrigerator 200 configured to cool air therein by using brine.

The brine circuit 9 includes a brine heat exchanger 91 performing heat exchange between the cooler 8 of the Stirling cryocooler 100 and the brine, a brine pump 92. circulating the brine in the brine circuit 9, and a switching valve 93 switching the brine to flow into any one of the heat exchanger 94 in the refrigerating compartment and the heat exchanger 95 in the freezing compartment. The brine heat exchanger is constituted by a flat pipe and wound around the cooler 8 of the Stirling cryocooler 100.

By using above-mentioned configuration, it is possible to maintain the refrigerating compartment and the freezing compartment at different temperatures by controlling the discharge amount of the pump 92 and the switching valve 93 while operating the Stirling cryocooler 100 at a constant number of revolutions.

Figure 9:
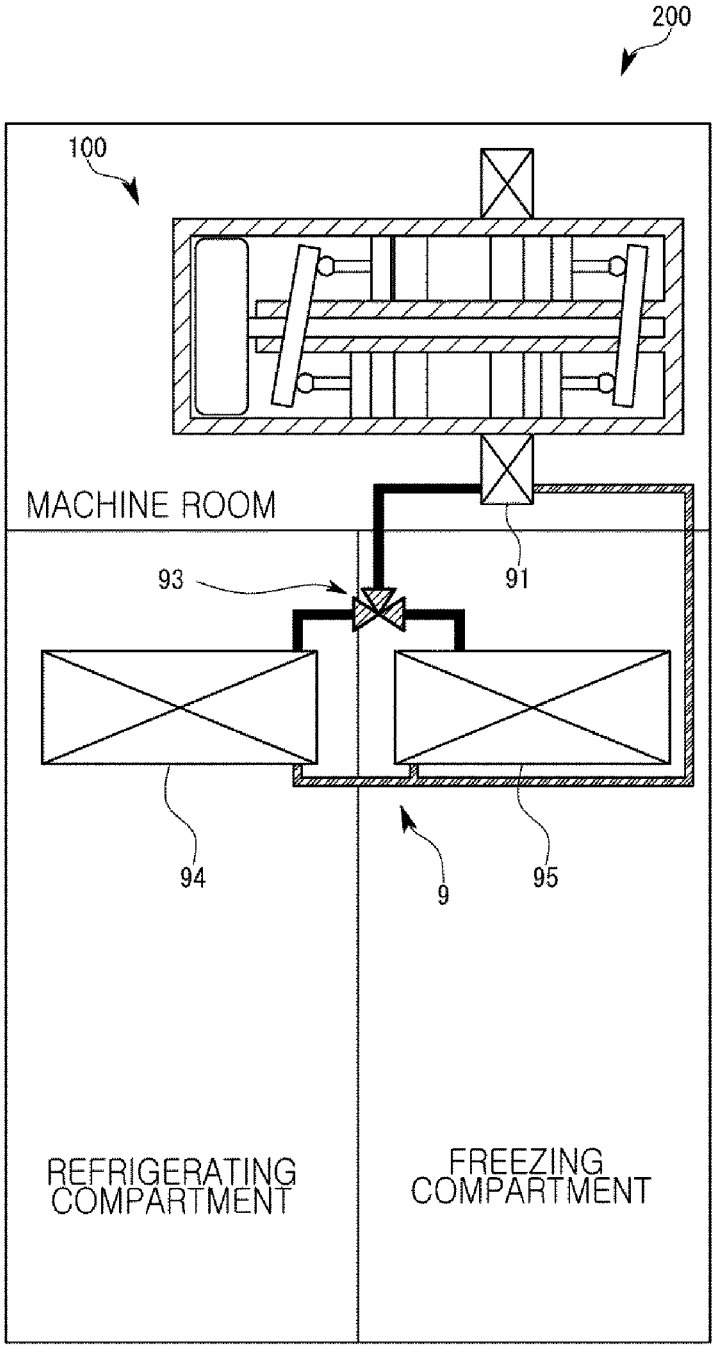
FIG. 9 is a schematic longitudinal sectional view illustrating a third modified example of the Stirling cryocooler and the refrigerator according to an embodiment of the disclosure.

In a modified example of the refrigerator 200 illustrated in FIG. 9, the brine circuit 9 is not provided with the pump 92 circulating the brine, and the brine is circulated by the thermosiphon.

Particularly, as illustrated in FIG. 9, the machine room is positioned above the refrigerating compartment and the freezing compartment, and brine, which is liquefied and heavy by being cooled by the Stirling cryocooler 100 installed in the upper side, flows to the heat exchanger 94 in the refrigerating compartment or the heat exchanger 95 in the freezing compartment, which are installed in the lower side. In the heat exchanger 94 in the refrigerating compartment or the heat exchanger 95 in the freezing compartment, heat exchange occurs between the air in the refrigerator and the brine, and thus the brine is vaporized, However, because in the brine heat exchanger 91, which is installed in the upper sides, the vaporized brine is liquefied by being cooled by the Stirling cryocooler 100, a pressure drop occurs in the brine heat exchanger 91. Due to this pressure drop, the brine, which is vaporized by the heat exchanger 94 in the refrigerating compartment or the heat exchanger 95 in the freezing compartment, is suctioned into the brine heat exchanger 91 installed in the upper side. Accordingly, the vaporized brine placed in the lower portion of the brine circuit 9 flows into the upper side and thus the brine returns to the brine heat exchanger 91.

With this configuration, because the pump 92 circulating the brine is not used, the power saving can be realized. Further, it is possible to vary a period of time for supplying the brine to the refrigerating compartment or the freezing compartment by the control of the switching valve 93, and thus it is possible to maintain the refrigerating compartment and the freezing compartment at a different temperature.

Other embodiments will be described.

Although the Stirling cryocooler described in each embodiment has been mainly described for use in a refrigerator, it may be used for other purposes. For example, a Stirling cryocooler according to the disclosure may be used as a car air conditioner or other air conditioner.

Further, the Stirling cryocooler may be used not only for cooling but also the Stirling cryocooler may be used as a heat pump for heating air or brine by a heater.

Although the number of sets of the compression cylinder and the expansion cylinder shown in each of the embodiments is four, it is possible to install the larger number of sets of the compression cylinder and the expansion cylinder, and thus it is possible to further increase the amount of cooling by using a single Stirling cryocooler. Alternatively, the number of sets of the compression cylinder and the expansion cylinder may be appropriately selected according to the usage and the purpose. For example, a set of the compression cylinder and the expansion cylinder may be arranged by each 45° in the circumferential direction, and thus eight sets of the compression cylinder and the expansion cylinder may be arranged in the casing. in contrast, the number of sets of the compression cylinder and the expansion cylinder may be reduced to one, two, or three sets.

The configuration of the heater, the regenerator, and the cooler is not limited to the configuration shown in each embodiment. Other known configurations may be used.

It is also possible to modify part of each embodiment or to combine part or all of the embodiments with each other so long as departing from the principles and spirit of the disclosure.

As is apparent from the above description, by using the Stirling cryocooler, it is possible to form the phase difference between the compression piston and the expansion piston by the compression swash plate and the expansion swash plate and thus it is not required to form the phase difference by the arrangement of the compression cylinder and the expansion cylinder. Accordingly, because the compression cylinder and the expansion cylinder are arranged in a line, it is possible to minimize a flow path on which the working fluid flows, and to reduce the dead volume and the flow resistance, and thus it is possible to reduce the size of the product. Further, because the compression cylinder and the expansion cylinder through which the working fluid flows are arranged in a line, design restrictions are unlikely to occur, and an optimal design can be easily realized even when the number of sets of each cylinder is increased.

Although a few embodiments of the present disclosure have been shown and described, it would be appreciated by those skilled in the art that changes may be made in these embodiments without departing from the principles and spirit of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

a cool air supplying apparatus comprising:

a motor, a shaft configured to extend in a direction of extension of a rotation axis of the motor, a first swash plate obliquely coupled to the shaft with respect to an extending direction of the shaft, a compression piston arranged on the first swash plate and configured to reciprocate in the extending direction of the shaft by rotation of the first swash plate, a compression cylinder in which a refrigerant is compressed by the compression piston, a second swash plate obliquely coupled to the draft with respect to the extending direction of the shaft, an expansion piston arranged on the second swash plate and configured to reciprocate in the extending direction of the shaft by the rotation of the second swash plate, an expansion cylinder in which the refrigerant is expanded by the expansion piston, a heater configured to perform change between the refrigerant, which is compressed in the compression cylinder, and outside air, a cooler configured to perform heat exchange between the refrigerant, which is expanded in the expansion cylinder, and outside air, and a regenerator configured to accumulate heat of the refrigerant passed through the heater and supply the accumulated heat to the refrigerant passed through the cooler, wherein the heater, the cooler, and the regenerator are arranged between, and coaxial with, the compression cylinder and the expansion cylinder in the extending direction of the shaft, wherein the compression cylinder and the expansion cylinder are arranged to be aligned with the extending direction of the shaft, wherein with respect to the extending direction of the shaft, the heater is arranged adjacent to the compression cylinder, the cooler is arranged adjacent to the expansion cylinder, and the regenerator is arranged between the heater and the cooler, wherein one of the first swash plate and the second swash plate is configured to be adjusted in a circumferential direction of the shaft relative to the other of the first swash plate and the second swash plate so as to adjust a phase difference between the first swash plate and the second swash plate and to adjust a phase difference between a reciprocating motion of the compression piston and a reciprocating motion of the expansion piston, and wherein the first swash plate and the second swash plate allow the compression piston and the expansion piston to reciprocate with the phase difference.

2. The refrigerator of claim 1, wherein the first swash plate and the second swash plate allow the compression piston and the expansion piston to reciprocate with the phase difference equal to or greater than 80 degrees and equal to or less than 100 degrees.

3. The refrigerator of claim 2, wherein the first swash plate and the second swish plate allow the compression piston and the expansion piston to reciprocate with the phase difference equal to 90 degrees.

4. The refrigerator of claim 1, wherein a pressure surface of the compression piston and a pressure surface of the expansion piston are arranged to face each other.

5. The refrigerator of claim 1, further comprising a housing configured to form an appearance of the cool air supplying apparatus, wherein the heater, the cooler, and the regenerator are arranged inside the housing.

6. A cool air supplying apparatus comprising:

a motor;

a shaft configured to extend in a direction of extension of a rotation axis of the motor;

a first swash plate obliquely coupled to the shaft with respect to an extending direction of the shaft;

a compression piston arranged on the first swash plate and configured to reciprocate in the extending direction of the shaft by rotation of the first sash plate;

a compression cylinder in which a refrigerant is compressed by the compression piston;

a second swash plate obliquely coupled to the shaft with respect to the extending direction of the shaft;

an expansion piston arranged on the second swash plate and configured to reciprocate in the extending direction of the shaft by the rotation of the second swash plate;

an expansion cylinder in which the refrigerant is expanded by the expansion piston;

a heater configured to perform heat exchange between the refrigerant, which is compressed in the compression cylinder, and outside air;

a cooler configured to perform heat exchange between the refrigerant, which is expanded in the expansion cylinder, and outside air, and a regenerator configured to accumulate heat of the refrigerant passed through the heater and supply the accumulated heat to the refrigerant passed through the cooler, wherein the heater, the cooler, and the regenerator are arranged between, and coaxial with the compression cylinder and the expansion cylinder in the extending direction the shaft, wherein the first swash plate and the second swash plate allow the compression piston and the expansion piston to reciprocate with a phase difference, wherein one of the first swash plate and the second swash plate is configured to be adjusted in a circumferential direction of the shaft relative to the other of the first swash plate and the second swash plate so as to adjust a phase difference between the first swash plate and the second swash plate and to adjust a phase difference between a reciprocating motion of the compression piston and a reciprocating motion of the expansion piston, wherein the compression cylinder and the expansion cylinder are arranged to be aligned with the extending direction of the shaft, and wherein with respect to the extending direction of the shaft, the heater is arranged adjacent to the compression cylinder the cooler is arranged adjacent to the expansion cylinder, and the regenerator is arranged between the heater and the cooler.

7. The cool air supplying apparatus of claim 6, further comprising:

a housing configured to form an appearance of the cool air supplying apparatus, wherein the heater, the cooler, and the regenerator are arranged inside the housing.

8. The cool air supplying apparatus of claim 6, wherein a pressure surface of the compression piston and a pressure surface of tile, expansion piston are arranged to face each other.

9. The cool air supplying apparatus of claim 6, wherein the first swash plate and the second swash plate allow the compression piston and the expansion piston to reciprocate with the phase difference equal to or greater than 80 degrees and equal to or less than 100 degrees.

10. The cool air supplying apparatus of claim 9, wherein the first swash plate and the second swash plate allow the compression piston and the expansion piston to reciprocate with the phase difference equal to 90 degrees.

* * * * *